US010551754B2

(12) United States Patent
Suzuki et al.

(10) Patent No.: US 10,551,754 B2
(45) Date of Patent: Feb. 4, 2020

(54) METHOD OF PRODUCING AN ELECTROPHOTOGRAPHIC PHOTORECEPTOR

(71) Applicant: FUJI ELECTRIC CO., LTD., Kawasaki-shi, Kanagawa (JP)

(72) Inventors: Shinjiro Suzuki, Matsumoto (JP); Tomoki Hasegawa, Hachioji (JP); Hirotaka Kobayashi, Matsumoto (JP)

(73) Assignee: FUJI ELECTRIC CO., LTD., Kawasaki-Shi, Kanagawa (JP)

( * ) Notice: Subject to any disclaimer, the term of this patent is extended or adjusted under 35 U.S.C. 154(b) by 0 days.

(21) Appl. No.: 15/801,286

(22) Filed: Nov. 1, 2017

(65) Prior Publication Data

US 2018/0088475 A1 Mar. 29, 2018

Related U.S. Application Data

(63) Continuation of application No. PCT/JP2015/066342, filed on Jun. 5, 2015.

(51) Int. Cl.

| | |
|---|---|
| ***G03G 5/05*** | (2006.01) |
| ***G03G 5/047*** | (2006.01) |
| ***G03G 5/06*** | (2006.01) |

(52) U.S. Cl.

CPC ..... *G03G 5/0564* (2013.01); *G03G 5/047* (2013.01); *G03G 5/0525* (2013.01); *G03G 5/0614* (2013.01); *G03G 5/0696* (2013.01)

(58) Field of Classification Search

CPC ..... G03G 5/047; G03G 5/05; G03G 5/0557; G03G 5/0596; G03G 5/056; G03G 5/0564

See application file for complete search history.

(56) References Cited

U.S. PATENT DOCUMENTS

| | | | | |
|---|---|---|---|---|
| 5,213,924 | A | 5/1993 | Sakamoto | |
| 6,026,262 | A | 2/2000 | Kinoshita et al. | |
| 2007/0212627 | A1 | 9/2007 | Yanagawa et al. | |
| 2015/0346614 | A1* | 12/2015 | Suzuki | G03G 5/0517 430/56 |

FOREIGN PATENT DOCUMENTS

| | | | |
|---|---|---|---|
| JP | S61-62040 | A | 3/1986 |
| JP | H03-273256 | A | 12/1991 |
| JP | H04-179961 | A | 6/1992 |

(Continued)

*Primary Examiner* — Peter L Vajda

(74) *Attorney, Agent, or Firm* — Rabin & Berdo, P.C.

(57) ABSTRACT

A method of producing an electrophotographic photoreceptor composed of a photosensitive layer provided on a conductive substrate, includes, in the formation of an outermost layer, controlling slope k of a straight line obtained by plotting the average film density of outermost layer and boiling point of solvent used for the formation of the outermost layer along the ordinate and the abscissa, respectively, to be 1.50E-4 ($g/cm^3 \cdot °C$) or greater, and adjusting the difference in film density of the outermost layer between the surface side and the side close to the conductive substrate to be 0.030 $g/cm^3$ or less. The electrophotographic photoreceptor has reduced image defects even after long-term use and has excellent wear performance.

1 Claim, 4 Drawing Sheets

(56) References Cited

FOREIGN PATENT DOCUMENTS

| | | | |
|---|---|---|---|
| JP | H06-236044 | A | 8/1994 |
| JP | H07-160013 | A | 6/1995 |
| JP | 2000-003050 | A | 1/2000 |
| JP | 2001-305754 | A | 11/2001 |
| JP | 2002-221810 | A | 8/2002 |
| JP | 2003-140373 | A | 5/2003 |
| JP | 2004-085644 | A | 3/2004 |
| JP | 2004-177464 | A | 6/2004 |
| JP | 2004-246150 | A | 9/2004 |
| JP | 2004-354759 | A | 12/2004 |
| JP | 2007-241158 | A | 9/2007 |
| JP | 2009-282281 | A | 12/2009 |
| JP | 2010-276699 | A | 12/2010 |
| JP | 2013-011885 | A | 1/2013 |
| TW | 201508426 | A | 3/2015 |

* cited by examiner

METHOD OF PRODUCING AN ELECTROPHOTOGRAPHIC PHOTORECEPTOR

CROSS-REFERENCE TO RELATED APPLICATIONS

This application is a continuation of PCT Application No. PCT/JP2015/066342 filed Jun. 5, 2015, the entire contents of which are incorporated herein by reference.

BACKGROUND OF THE INVENTION

1. Field of the Invention

The present invention relates to: an electrophotographic photoreceptor (hereinafter, also simply referred to as "photoreceptor") used in electrophotographic printers, copying machines, fax machines and the like; and a method of producing the same. More particularly, the present invention relates to: an electrophotographic photoreceptor which comprises an outermost layer having specific film physical properties and thereby exhibits excellent contamination resistance, stability of electrical characteristics and wear resistance; a method of producing the same; and an electrophotographic device.

2. Background of the Related Art

Electrophotographic photoreceptors have a basic structure in which a photosensitive layer having a photoconductive function is disposed on a conductive substrate. In recent years, organic electrophotographic photoreceptors using organic compounds as functional components for generation and transport of charge have been actively studied and developed and increasingly applied to copying machines, printers and the like because of their advantages such as material diversity, high productivity and safety.

In general, photoreceptors are required to have a function of retaining a surface charge in dark places and a function of receiving light and generating a charge, as well as a function of transporting the thus generated charge. Such photoreceptors include so-called single layer-type photoreceptors that comprise a single photosensitive layer having a combination of these functions; and so-called laminate-type (function-separated) photoreceptors that comprise a photosensitive layer in which functionally separated layers, such as a charge generation layer mainly having a function of generating a charge upon receiving light and a charge transport layer having both functions of retaining a surface charge in dark places and transporting the charge generated by the charge generation layer upon receiving light, are laminated.

The above-described photosensitive layers are generally formed by coating a conductive substrate with a coating liquid in which a charge generating material, a charge transport material and a resin binder are dissolved or dispersed in an organic solvent. Particularly, in the layers constituting the outermost surfaces of these organic electrophotographic photoreceptors, polycarbonates are often used as the resin binder because of their strength against friction with paper and a toner-removing blade, excellent flexibility and good permeability of exposure light. Thereamong, bisphenol Z-type polycarbonates are widely used as the resin binder. Technologies utilizing such a polycarbonate as a resin binder are described in, for example, Patent Document 1.

In association with, for example, the recent increase in printing volume due to networking in offices and the rapid development of light printers utilizing electrophotography, electrophotographic printers are now demanded to have even greater durability and higher sensitivity as well as faster response.

In addition, with the recent development and increase in usage of color printers, the printing speed has been increased and the printer size and the number of printer components have been further reduced, and the printers are demanded to cope with a variety of use environments. Under such circumstances, there is a pressing need for photoreceptors that exhibit little variation in image and electrical characteristics caused by repeated use and fluctuations in the use environment (room temperature and ambient conditions), and conventional technologies can no longer simultaneously and adequately satisfy these demands.

Furthermore, the photoreceptor surface may be contaminated not only by ozone, nitrogen oxides and the like that are generated during charging but also by paper and members such as rollers that come into contact with the photoreceptor. When such contamination occurs, there are problems that the contaminants themselves cause image deletion and the lubricity of the photoreceptor surface is reduced by the adhering substances, making adhesion of paper dust and toner, blade squealing, peeling, surface damage and the like more likely to occur. For such deterioration in properties, the properties are maintained in some cases by gradually scraping off the outermost layer itself of the photoreceptor through friction with the above-described various members and thereby renewing the photoreceptor surface.

In order to solve the above-described problems, a variety of methods for improving the outermost layer of a photoreceptor have been proposed.

For the purpose of improving the durability of the photoreceptor surface, polycarbonate resins having various structures have been proposed. For instance, Patent Documents 2 and 3 propose polycarbonate resins containing a specific structure; however, neither the compatibility with various charge transport agents and additives nor the solubility of the resins are sufficiently examined therein. Patent Document 4 also proposes a polycarbonate resin containing a specific structure; however, it is difficult to achieve sufficient durability since a resin having a bulky structure contains a number of spaces between polymers, and discharging substances generated during charging as well as members in contact, foreign matters and the like thus readily permeate into the photosensitive layer. Further, for the purpose of improving the printing durability and the coatability, Patent Document 5 proposes a polycarbonate having a special structure; however, Patent Document 5 does not offer sufficient description with regard to the charge transport materials and additives that may be used in combination, and there is a problem in that maintenance of stable electrical characteristics in long-term use is difficult.

Patent Documents 7 and 8 include proposals concerning an improvement in the wear resistance of photosensitive layers; however, the effects against image defects of the photosensitive layers are not sufficiently examined. Moreover, Patent Document 9 discloses a technology relating to the surface layers of photosensitive layers, and Patent Document 10 discloses a technology in which at least one end of a charge generation layer is made discontinuous and the charge generation layer is completely covered with a charge transport layer; however, these technologies are not examined in association with image defects. Furthermore, Patent Document 11 discloses a technology in which a copolymer of a prescribed triarylaminoacrylate monomer and a prescribed divinyl compound is incorporated into a photosensitive layer; however, no examination is made with regard to the film density of the photosensitive layer and image defects.

Related patent documents discussed herein include Patent Document 1: Japanese Unexamined Patent Application Publication No. S61-62040; Patent Document 2: Japanese Unexamined Patent Application Publication No. 2004-354759; Patent Document 3: Japanese Unexamined Patent Application Publication No. H4-179961; Patent Document 4: Japanese Unexamined Patent Application Publication No. 2004-85644; Patent Document 5: Japanese Unexamined Patent Application Publication No. H3-273256; Patent Document 6: Japanese Unexamined Patent Application Publication No. 2010-276699; Patent Document 7: Japanese Unexamined Patent Application Publication No. 2004-246150; Patent Document 8: Japanese Unexamined Patent Application Publication No. 2001-305754; Patent Document 9: Japanese Unexamined Patent Application Publication No. 2007-241158; Patent Document 10: Japanese Unexamined Patent Application Publication No. H6-236044; and Patent Document 11: Japanese Unexamined Patent Application Publication No. 2002-221810.

As described above, a variety of technologies have already been proposed for improving the surface layers of photoreceptors. However, the technologies disclosed in these Patent Documents are not satisfactory in all aspects of actual use, such as image defects. Further, photoreceptors suitable for various electrophotographic devices are conventionally developed by examining a large number of combinations of many electronic materials; however, it is now also demanded to adjust the wear resistance without largely changing the functional materials and to achieve a cost reduction by standardizing the materials used in photoreceptor films and the production processes. Therefore, in recent years, there is a need for the development of a technology that is capable of more precisely adjusting the wear performance and applicable to various electrophotographic devices without largely changing the constituent materials and electrical characteristics of a photoreceptor.

In view of the above, an object of the present invention is to provide: an electrophotographic photoreceptor which causes no image defect even in long-term use and has excellent wear performance; a method of producing the same; and an electrophotographic device.

SUMMARY OF THE INVENTION

In order to solve the above-described problems, the present inventors intensively studied the film densities of the outermost layers of photoreceptors and the boiling points of solvents used in photosensitive layers, as a result of which the present inventors elucidated the photoreceptor film physical properties that are advantageous against image defects and thereby enabled to realize a photoreceptor that maintains stable image quality even after repeated use. Specifically, the present inventors discovered that an electrophotographic photoreceptor having superior image characteristics can be obtained by satisfying the below-described relationships, thereby completing the present invention.

The present inventors also discovered that, in electrophotographic photoreceptors comprising a photosensitive layer on a conductive substrate, there is a correlation between the film densities of outermost layers formed by changing the type of the solvent used for the formation and the boiling points of solvents. That is, the present inventors discovered that an increase in the solvent boiling point improves the compactness and thus the density of the resulting film and that, by allowing a photoreceptor to satisfy a certain relationship obtained by plotting the film density and the solvent boiling point, a stable image quality can be attained even in long-term use. Furthermore, the present inventors discovered that the wear performance of a photosensitive layer can be finely controlled by adjusting the compactness of a photoreceptor film based on the type of the solvent, without largely changing the functional material of the photoreceptor film.

That is, the electrophotographic photoreceptor according to one embodiment of the present invention is an electrophotographic photoreceptor comprising a conductive substrate and a photosensitive layer on the conductive substrate, the electrophotographic photoreceptor being characterized in that the slope k of a straight line obtained by plotting the average film density of outermost layer and the boiling point of solvent used for the formation of the outermost layer along the ordinate and the abscissa, respectively, is 1.50E-4 ($g/cm^3 \cdot {}^\circ C.$) or greater, and the difference in film density of the outermost layer between the surface side and the side close to the conductive substrate is 0.030 $g/cm^3$ or less.

The method of producing an electrophotographic photoreceptor according to one embodiment of the present invention is a method of producing an electrophotographic photoreceptor comprising a conductive substrate and a photosensitive layer on the conductive substrate, the method being characterized by comprising, in the formation of an outermost layer: controlling the slope k of a straight line obtained by plotting the average film density of the outermost layer and the boiling point of solvent used for the formation of the outermost layer along the ordinate and the abscissa, respectively, to be 1.50E-4 ($g/cm^3 \cdot {}^\circ C.$) or greater; and adjusting the difference in film density of the outermost layer between the surface side and the side close to the conductive substrate to be 0.030 $g/cm^3$ or less.

The electrophotographic device of the present invention is characterized by comprising the above-described electrophotographic photoreceptor.

According to the present invention, an electrophotographic photoreceptor which causes no image defect even in long-term use and has excellent wear performance, a method of producing the same, and an electrophotographic device can be realized.

DETAILED DESCRIPTION OF THE INVENTION

Figure 1A:
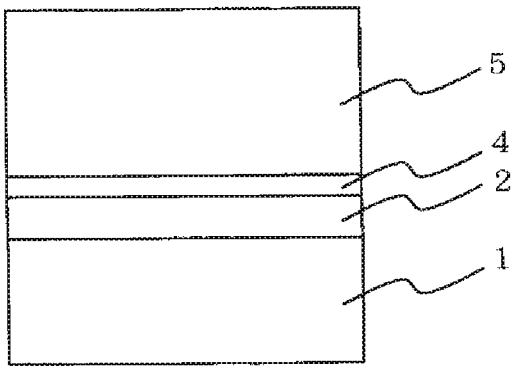
FIG. 1A is a schematic cross-sectional view showing one example of a negatively-chargeable laminate-type electrophotographic photoreceptor in the electrophotographic photoreceptors according to the present invention.

Concrete embodiments of the electrophotographic photoreceptor of the present invention will now be described in detail referring to the drawings. The present invention, however, is not restricted to the following descriptions by any means.

Figure 1B:
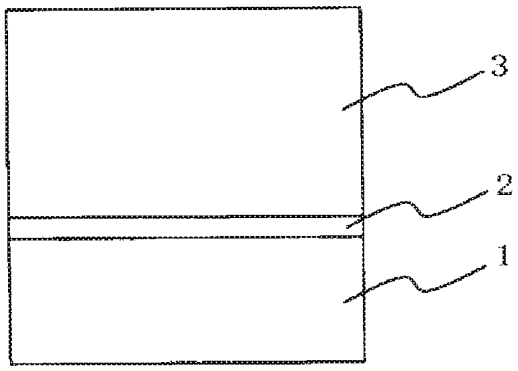
FIG. 1B is a schematic cross-sectional view showing one example of a positively-chargeable single layer-type electrophotographic photoreceptor in the electrophotographic photoreceptors according to the present invention.
Figure 1C:
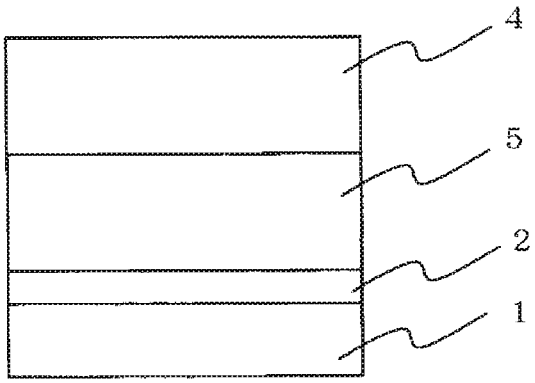
FIG. 1C is a schematic cross-sectional view showing one example of a positively-chargeable laminate-type electrophotographic photoreceptor in the electrophotographic photoreceptors according to the present invention.

As described above, electrophotographic photoreceptors are broadly classified into: laminate-type (function-separated) photoreceptors, which are so-called negatively-chargeable laminate-type photoreceptors and positively-chargeable laminate-type photoreceptors; and single layer-type photoreceptors which are mainly used in a positively-chargeable form. FIGS. 1A to 1C are schematic cross-sectional views showing examples of the electrophotographic photoreceptor according to the present invention, wherein FIGS. 1A, 1B and 1C illustrate a negatively-chargeable laminate-type electrophotographic photoreceptor, a positively-chargeable single layer-type electrophotographic photoreceptor and a positively-chargeable laminate-type electrophotographic photoreceptor, respectively. As illustrated, in the negatively-chargeable laminate-type photoreceptor of FIG. 1A, an undercoat layer 2 and a photosensitive layer comprising a charge generation layer 4 having a charge generation function and a charge transport layer 5 having a charge transport function are sequentially laminated on a conductive substrate 1. In the positively-chargeable single layer-type photoreceptor of FIG. 1B, an undercoat layer 2 and a single layer-type photosensitive layer 3 having both functions of charge generation and charge transport, are sequentially laminated on a conductive substrate 1. Further, in the positively-chargeable laminate-type photoreceptor of FIG. 1C, an undercoat layer 2 and a photosensitive layer comprising a charge transport layer 5 having a charge transport function and a charge generation layer 4 having both functions of charge generation and charge transport are sequentially laminated on a conductive substrate 1. It is noted here that the undercoat layer 2 may be arranged as required in any of these types of photoreceptors.

In the photoreceptor of the present invention, it is important that the slope k of a straight line obtained by plotting the average film density of the outermost layer and the boiling point of the solvent used for the formation of the outermost layer along the ordinate and the abscissa, respectively, be 1.50E-4 ($g/cm^3 \cdot °C$) or greater, and that the difference in film density of the outermost layer between the surface side and the side close to the conductive substrate be 0.030 $g/cm^3$ or less. That is, according to the present invention, although the mechanism is unclear, it was revealed that, by allowing the outermost layer of a photoreceptor to satisfy the above-prescribed relationship of the solvent used and the film density and by controlling the difference in film density along the thickness direction to be within the above-prescribed range, a photoreceptor which maintains stable image quality and whose wear performance is controllable can be obtained. It is noted here that "E" represents a power of 10 and, for example, 1.50E-4 is equal to $1.50 \times 10^{-4}$.

As described above, according to the investigations by the present inventors, there is a correlation between the film densities of outermost layers formed by changing the type of the solvent used for the formation and the boiling points of solvents, and it is believed that an increase in the boiling point of the solvent used improves the compactness and thus the density of the resulting film. In addition, as a result of further investigations, the present inventors discovered that good image quality can be stably obtained even in long-term use by forming the outermost layer such that a prescribed relationship is satisfied when the film density and the solvent boiling point are plotted along the ordinate and the abscissa, respectively. The reason for this is believed to be as follows. That is, when a low-boiling-point solvent is used for the film formation, it is believed that the density of the resulting film is reduced due to the high evaporation rate of the solvent and this creates a density difference between the surface side and the conductive substrate side of the outermost layer. It is believed that, as a result, the difference in film density along the thickness direction is increased and the residual stress in the film is also increased due to the difference in drying speed. Meanwhile, when a high-boiling-point solvent is used, it is believed that the compactness and thus the density of the resulting film are improved due to gradual evaporation of the solvent and that this results in a reduction in the film density difference along the thickness direction and a reduction in the residual stress in the film.

In this manner, the film density is improved by increasing the boiling point of the solvent and, when a material which yields a film having a large difference/change (slope) in film density is used, the residual stress in the resulting film is expected to be relatively small. Therefore, when a photoreceptor having an outermost layer formed under such conditions is mounted on an electrophotographic device, the possibilities that partial relaxation or partial concentration of the residual stress occurs in the film upon contact with a blade, paper or the like and the resulting film destruction at a micro level causes image defects such as black spots and white spots that originate from the sites of the film destruction are presumed to be low.

The above-described slope k is required to be 1.50E-4 ($g/cm^3 \cdot °C$) or greater and preferably, when the slope k is 2.50E-4 ($g/cm^3 \cdot °C$) or greater, good print quality can be maintained particularly for printing over a long period and against changes in the printing environment. The reason for this is also believed to be because, although the mechanism is not clear, by changing the type of the solvent used for the formation of the outermost layer and adopting a film-forming material that yields a film having a large density variation, the photoreceptor is made unlikely to be affected by stress even when printing is performed continuously or the printing environmental conditions are largely modified. The slope k can be obtained as the slope of a first-order approximation straight line which is determined by plotting the boiling points (° C.) of different solvents on the abscissa and the average film densities of outermost layers formed by using the solvents on the ordinate. Further, the average film density of an outermost layer can be determined by selecting three points along the axial direction, measuring the film density at each of the selected points and taking an average of the measured values. In the present invention, the larger the slope k, the more preferred it is.

Further, in the present invention, the difference in film density of the outermost layer along the thickness direction is required to be small and, in the outermost layer, the difference between the film density of the surface side and that of the side close to the conductive substrate is 0.030 g/cm$^3$ or less, preferably 0.025 g/cm$^3$ or less. In the outermost layer, the difference between the film density of the surface side and that of the side close to the conductive substrate can be substantially determined by trisecting the outermost layer along its thickness direction at a central part of the axial direction of the photoreceptor, measuring the film density for those parts on the surface side and the side close to the conductive substrate among the resulting three equal parts and then calculating the difference between the measured values. In the present invention, the smaller this difference in film density, the more preferred it is.

Further, in the present invention, the difference in film density of the outermost layer along the axial direction is also preferred to be small. The difference in film density of the outermost layer along the axial direction is preferably 0.030 g/cm$^3$ or less, more preferably 0.025 g/cm$^3$ or less. In the outermost layer, the difference in film density along the axial direction can be substantially determined by trisecting the outermost layer along its thickness direction in the regions of 10% of the full length of the photoreceptor from the respective ends along the axial direction, measuring the film density for all of the resulting equal parts and then calculating the difference between the thus obtained maximum and minimum values. In the present invention, the smaller this difference in film density, the more preferred it is.

In the present invention, the solvent used for the formation of the outermost layer is not particularly restricted. The solvent can be selected as appropriate from conventionally and commonly used solvents, and such solvents may be used individually or in combination of two or more thereof. Specific examples of the solvent include halogenated hydrocarbons, such as dichloromethane, dichloroethane, chloroform, carbon tetrachloride and chlorobenzene; ethers, such as dimethyl ether, diethyl ether, tetrahydrofuran, tetrahydropyran, dioxane, dioxolane, ethylene glycol dimethyl ether and diethylene glycol dimethyl ether; and ketones, such as acetone, methyl ethyl ketone and cyclohexanone, among which dichloromethane, 1,3-dioxolane, tetrahydropyran, 1,2-dichloroethane and tetrahydrofuran are preferred. In addition, other solvents that are not mentioned above may also be used in combination as long as the range of slope k and the film density can be realized as prescribed in the present invention. In the present invention, particularly, it is preferred to use a solvent having a boiling point in a range of 40° C. to 120° C. as a main solvent for the formation of the outermost layer since it enables to easily obtain a photoreceptor that satisfies the above-described conditions of the present invention. The term "main solvent" used herein refers to a solvent that accounts for not less than 50% by mass, preferably not less than 70% by mass, with respect to the total amount of solvents used for the formation of the outermost layer.

In the photoreceptor of the present invention, what is important is only that the outermost layer satisfies the above-described conditions, and other aspects can be configured as appropriate in accordance with conventional methods and are not particularly restricted.

Conductive Substrate

The conductive substrate 1 not only functions as an electrode of the photoreceptor but also serves as a support of the layers constituting the photoreceptor at the same time, and the conductive substrate 1 may take any form, such as a cylindrical form, a plate form or a film form. As the material of the conductive substrate 1, for example, a metal such as aluminum, stainless steel or nickel, or glass or a resin whose surface has been subjected to a conductive treatment can be used.

Undercoat Layer

The undercoat layer 2 is composed of a layer containing a resin as a main component or a metal oxide film of alumite or the like. The undercoat layer 2 is provided as required for the purposes of, for example, controlling the injectability of charge from the conductive substrate 1 into the photosensitive layer, covering surface defects of the conductive substrate and improving the adhesion between the photosensitive layer and the conductive substrate 1. Examples of a resin material used in the undercoat layer 2 include insulating polymers, such as casein, polyvinyl alcohol, polyamide, melamine and cellulose; and conductive polymers, such as polythiophene, polypyrrole and polyaniline, and these resins can be used individually or as a mixture of an appropriate combination. In addition, these resins may contain a metal oxide, such as titanium dioxide or zinc oxide.

Negatively-Chargeable Laminate-Type Photoreceptor

The photoreceptor of the present invention may take any of the layer constitutions shown in FIGS. 1A to 1C as long as the above-described conditions relating to the outermost layer are satisfied. The photoreceptor of the present invention is preferably a negatively-chargeable laminate-type electrophotographic photoreceptor and, in this case, the outermost layer is a charge transport layer. As described above, in the negatively-chargeable laminate-type photoreceptor, the photosensitive layer comprises the charge generation layer 4 and the charge transport layer 5.

The charge generation layer 4 is formed by, for example, a method of applying a coating liquid in which particles of a charge generating material are dispersed in a resin binder, and the charge generation layer 4 generates a charge upon receiving light. It is important that the charge generation layer 4 have high charge generation efficiency and an ability to inject the generated charge into the charge transport layer 5 at the same time, and the charge generation layer 4 is desired to have little electric field dependence and exhibit good injection even in a low electric field.

Examples of the charge generating material include phthalocyanine compounds, such as X-type metal-free phthalocyanine, τ-type metal-free phthalocyanine, α-type titanyl phthalocyanine, β-type titanyl phthalocyanine, Y-type titanyl phthalocyanine, γ-type titanyl phthalocyanine, amorphous titanyl phthalocyanine and ε-type copper phthalocyanine; various azo pigments; anthraquinone pigments; thiapyrylium pigments; perylene pigments; perinone pigments; squarylium pigments; and quinacridone pigments, and these charge generating materials can be used individually or in an appropriate combination. A suitable substance can be selected as appropriate in accordance with the wavelength region of the exposure light source used for image formation.

Examples of the resin binder of the charge generation layer 4 include polymers and copolymers of polycarbonate resins, polyester resins, polyamide resin, polyurethane resins, vinyl chloride resins, vinyl acetate resins, phenoxy resins, polyvinyl acetal resins, polyvinyl butyral resins, polystyrene resins, polysulfone resins, diallyl phthalate resins and methacrylate resins, which can be used in an appropriate combination.

The content of the resin binder in the charge generation layer 4 is preferably 20 to 80% by mass, more preferably 30 to 70% by mass, with respect to the solid content of the charge generation layer 4.

The content of the charge generating material(s) in the charge generation layer 4 is preferably 20 to 80% by mass, more preferably 30 to 70% by mass, with respect to the solid content of the charge generation layer 4.

The charge generation layer 4 is only required to have a charge generation function, and the film thickness thereof is thus generally 1 μm or less, preferably 0.5 μm or less. The charge generation layer 4 comprises a charge generating material as a main component, and a charge transport material and the like can also be added thereto.

The charge transport layer 5 is mainly composed of a charge transport material and a resin binder. As the resin binder of the charge transport layer 5, polyarylate resins and various other polycarbonate resins, such as, bisphenol A-type polycarbonates, bisphenol Z-type polycarbonates, bisphenol A-type polycarbonate-biphenyl copolymers and bisphenol Z-type polycarbonate-biphenyl copolymers, can be used. Further, a mixture of resins of the same kind but with different molecular weights may be used as well. As the resin binder of the charge transport layer 5, it is preferred to use a bisphenol Z structure-containing polycarbonate resin. By using a bisphenol Z structure-containing polycarbonate resin as the resin binder of the charge transport layer 5 serving as the outermost layer, effects can be obtained because of the appropriate compatibility of the resin binder in combinations with other functional materials and solvents as well as the characteristics of the resin skeleton itself, although the mechanism thereof is not clear. In the same manner, also for photoreceptors having other layer constitution, it is preferred to incorporate a bisphenol Z structure-containing polycarbonate resin into the outermost layer.

The weight-average molecular weight of the above-described resin, which is determined by GPC (gel permeation chromatography) analysis in terms of polystyrene, is preferably 5,000 to 250,000, more preferably 10,000 to 200,000.

Examples of the charge transport material of the charge transport layer 5 include various hydrazone compounds, styryl compounds, diamine compounds, butadiene compounds and indole compounds, and these compounds can be used individually or as a mixture of an appropriate combination. Examples of the charge transport material include, but not limited to, the following compounds represented by (II-1) to (II-25).

II-1

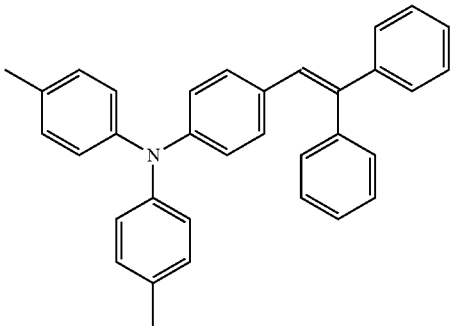

II-2

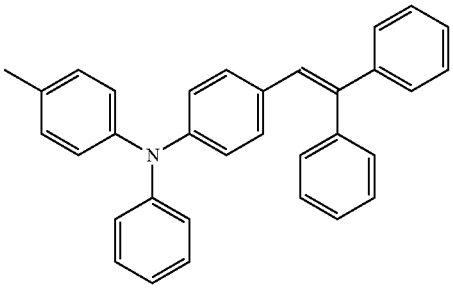

II-3

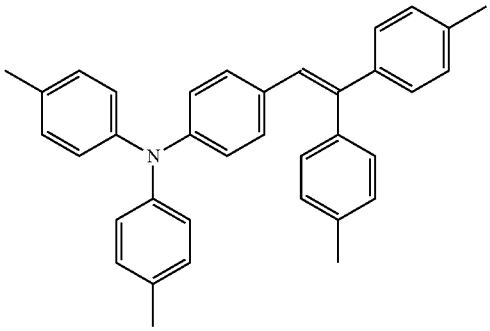

II-4

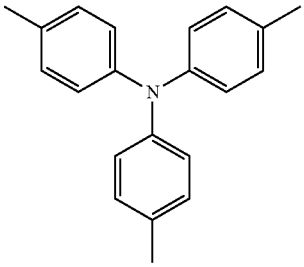

II-5

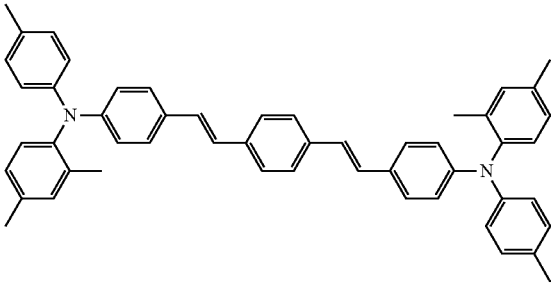

II-6

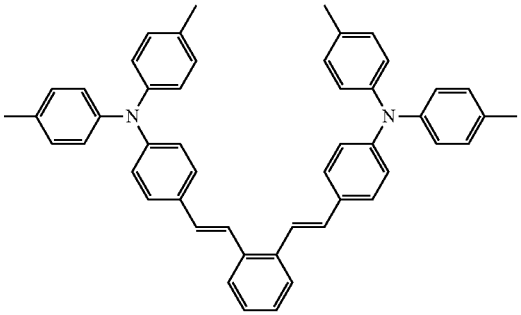

-continued
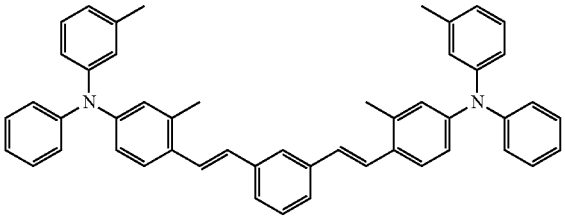
II-8
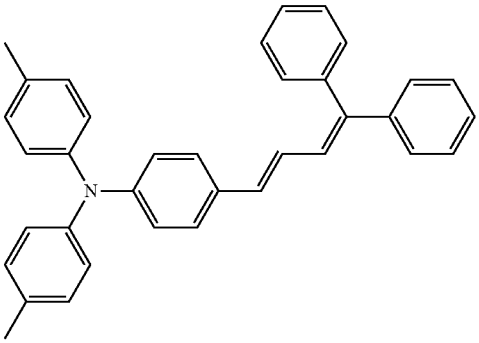
II-9
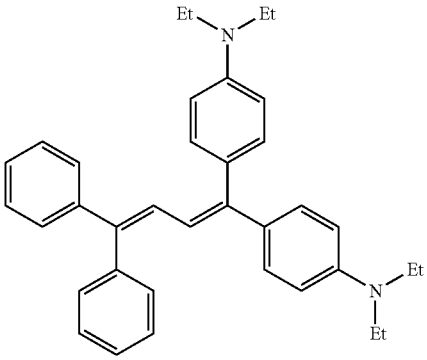
II-10
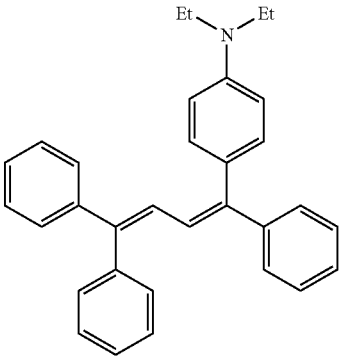
II-11
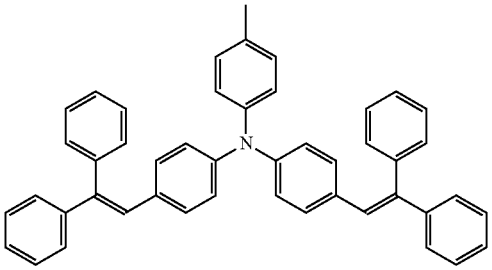
II-12
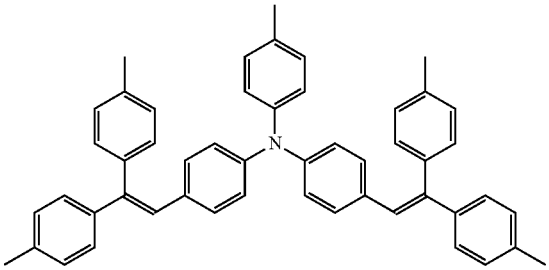
II-13
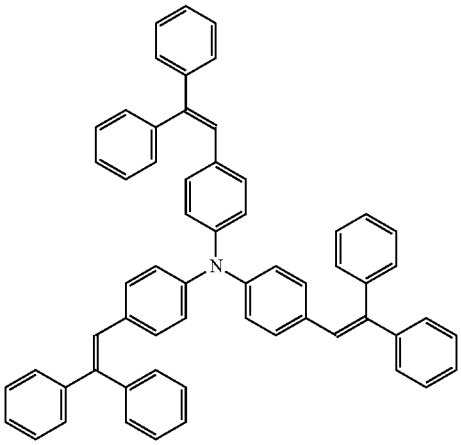
II-14
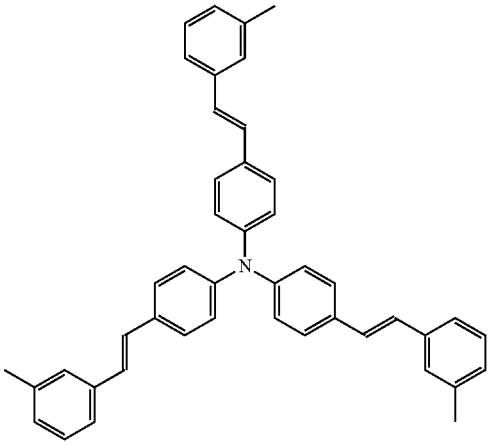

-continued
II-15
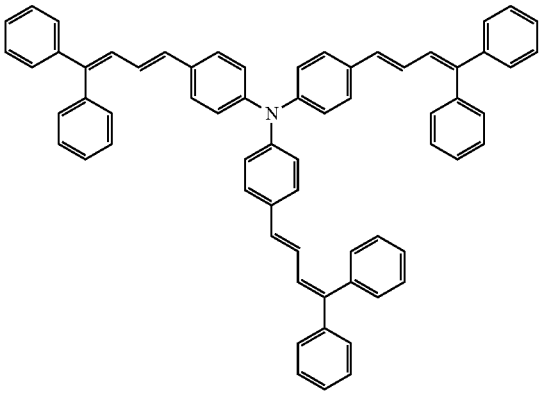
II-16
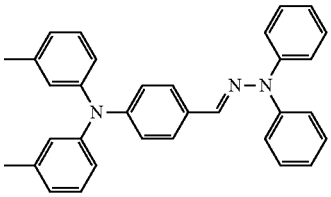
II-18
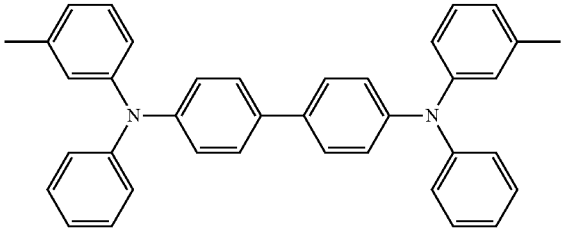
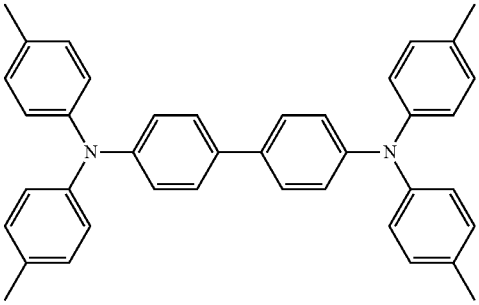
II-19
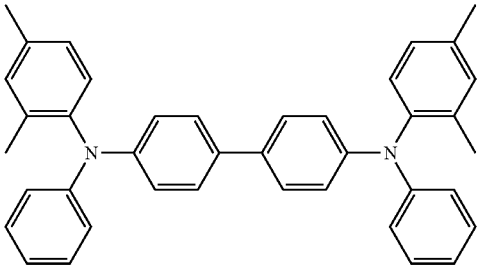
II-20
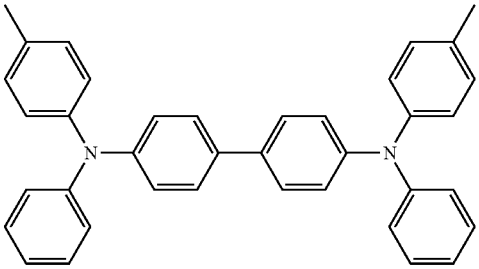
II-21
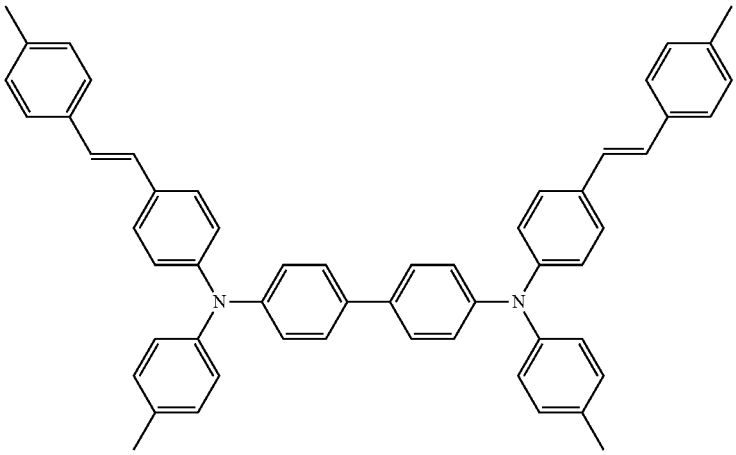

-continued

II-22

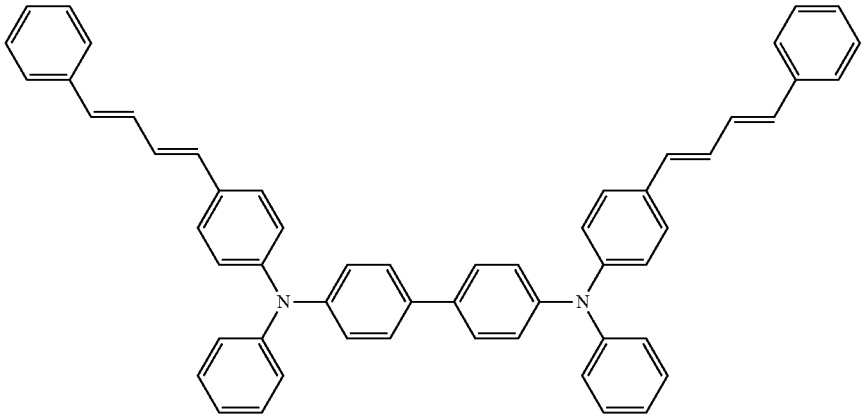

II-23

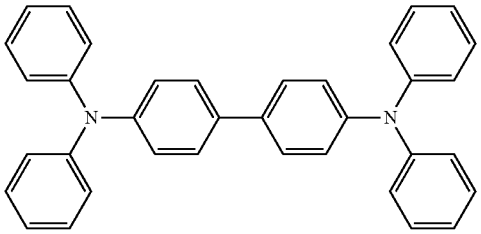

II-24

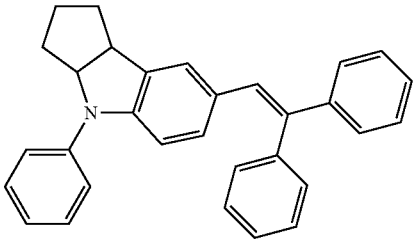

II-25

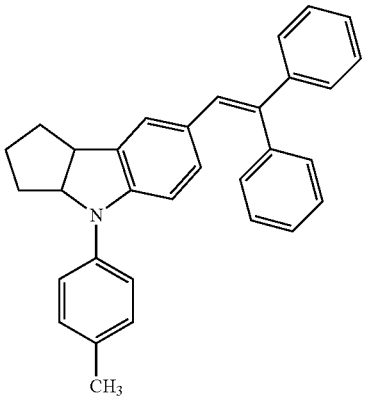

The content of the resin binder in the charge transport layer 5 is preferably 20 to 90% by mass, more preferably 30 to 80% by mass, with respect to the solid content of the charge transport layer 5.

The content of the charge transport material(s) in the charge transport layer 5 is preferably 10 to 80% by mass, more preferably 20 to 70% by mass, with respect to the solid content of the charge transport layer 5.

Further, in the present invention, the total amount of the charge transport material(s) and the resin binder that are contained in the charge transport layer 5 is preferably not less than 90% by mass, particularly preferably not less than 95% by mass, with respect to the solid content of the charge transport layer 5. By controlling the total amount of the charge transport material(s) and the resin binder that are contained in the charge transport layer 5 to be in the above-described range, as described below, the film density of the outermost layer is increased and the amount of wear of the outermost layer when the photoreceptor is mounted on an apparatus is thereby easily reduced.

In order to maintain a practically effective surface potential, the film thickness of the charge transport layer 5 is in a range of preferably 3 to 50 μm, more preferably 15 to 40 μm.

Positively-Chargeable Single Layer-Type Photoreceptor

In the positively-chargeable single layer-type photoreceptor, the single layer-type photosensitive layer 3 is mainly composed of a charge generating material, a hole transport material, an electron transport material (acceptor compound) and a resin binder. In this case, the single layer-type photosensitive layer 3 constitutes the outermost layer.

Examples of the resin binder that can be used in the single layer-type photosensitive layer 3 include various polycarbonate resins other than the above-mentioned ones, such as bisphenol A-type polycarbonates, bisphenol Z-type polycarbonates, bisphenol A-type polycarbonate-biphenyl copolymers and bisphenol Z-type polycarbonate-biphenyl copolymers; polyphenylene resins; polyester resins; polyvinyl acetal resins; polyvinyl butyral resins; polyvinyl alcohol resins; vinyl chloride resins; vinyl acetate resins; polyethylene resins; polypropylene resins; acrylic resins; polyurethane resins; epoxy resins; melamine resins; silicone resins;

polyamide resins; polystyrene resins; polyacetal resins; other polyarylate resins; polysulfone resins; methacrylate polymers; and copolymers of these resins. Further, a mixture of resins of the same kind but with different molecular weights may be used as well.

The content of the resin binder is preferably 10 to 90% by mass, more preferably 20 to 80% by mass, with respect to the solid content of the single layer-type photosensitive layer 3.

Examples of the charge generating material that can be used in the single layer-type photosensitive layer 3 include phthalocyanine pigments, azo pigments, anthraquinone pigments, perylene pigments, perinone pigments, polycyclic quinone pigments, squarylium pigments, thiapyrylium pigments, and quinacridone pigments. These charge generating materials can be used individually or in a combination of two or more thereof. Particularly, in the photoreceptor of the present invention, it is preferred to use an azo pigment such as a disazo pigment or a trisazo pigment, a perylene pigment such as N,N'-bis(3,5-dimethylphenyl)-3,4:9,10-perylene-bis (carboximide), or a phthalocyanine pigment such as metal-free phthalocyanine, copper phthalocyanine or titanyl phthalocyanine. Further, the use of X-type metal-free phthalocyanine, τ-type metal-free phthalocyanine, ε-type copper phthalocyanine, α-type titanyl phthalocyanine, β-type titanyl phthalocyanine, Y-type titanyl phthalocyanine, amorphous titanyl phthalocyanine or a titanyl phthalocyanine which has a maximum peak at a Bragg angle (2θ) of 9.6° in the CuKα:X-ray diffraction spectrum as described in Japanese Unexamined Patent Application Publication No. H8-209023, U.S. Pat. Nos. 5,736,282 or 5,874,570 exhibits markedly improved effects in terms of sensitivity, durability and image quality and is thus preferred. The content of the charge generating material(s) is preferably 0.1 to 20% by mass, more preferably 0.5 to 10% by mass, with respect to the solid content of the single layer-type photosensitive layer 3.

Examples of the hole transport material that can be used in the single layer-type photosensitive layer 3 include hydrazone compounds, pyrazoline compounds, pyrazolone compounds, oxadiazole compounds, oxazole compounds, arylamine compounds, benzidine compounds, stilbene compounds, styryl compounds, poly-N-vinylcarbazoles, and polysilanes. These hole transport materials can be used individually or in a combination of two or more thereof. The hole transport material used in the present invention is preferably one which has excellent ability to transport holes generated during exposure and is suitable for combining with the charge generating material. The content of the hole transport material(s) is preferably 3 to 80% by mass, more preferably 5 to 60% by mass, with respect to the solid content of the single layer-type photosensitive layer 3.

Examples of the electron transport material (acceptor compound) of the single layer-type photosensitive layer 3 include succinic anhydride, maleic anhydride, dibromosuccinic anhydride, phthalic anhydride, 3-nitrophthalic anhydride, 4-nitrophthalic anhydride, pyromellitic anhydride, pyromellitic acid, trimellitic acid, trimellitic anhydride, phthalimide, 4-nitrophthalimide, tetracyanoethylene, tetracyanoquinodimethane, chloranil, bromanil, o-nitrobenzoic acid, malononitrile, trinitrofluorenone, trinitrothioxanthone, dinitrobenzene, dinitroanthracene, dinitroacridine, nitroanthraquinone, dinitroanthraquinone, thiopyran compounds, quinone compounds, benzoquinone compounds, diphenoquinone compounds, naphthoquinone compounds, anthraquinone compounds, stilbenequinone compounds, and azoquinone compounds. These electron transport materials can be used individually or in a combination of two or more thereof. The content of the electron transport material(s) is preferably 1 to 50% by mass, more preferably 5 to 40% by mass, with respect to the solid content of the single layer-type photosensitive layer 3.

In order to maintain a practically effective surface potential, the film thickness of the single layer-type photosensitive layer 3 is in a range of preferably 3 to 100 μm, more preferably 5 to 40 μm.

Positively-Chargeable Laminate-Type Photoreceptor

In the positively-chargeable laminate-type photoreceptor, the charge transport layer 5 is mainly composed of a charge transport material and a resin binder. As the charge transport material and the resin binder, the same materials as those exemplified above for the charge transport layer 5 of the negatively-chargeable laminate type photoreceptor can be used. The contents of the respective materials and the film thickness of the charge transport layer 5 can also be the same as in the negatively-chargeable laminate type photoreceptor.

The charge generation layer 4 arranged on the charge transport layer 5 is mainly composed of a charge generating material, a hole transport material, an electron transport material (acceptor compound) and a resin binder. In this case, the charge generation layer 4 constitutes the outermost layer. As the charge generating material, the hole transport material, the electron transport material and the resin binder, the same materials as those exemplified above for the single layer-type photosensitive layer 3 of the single layer-type photoreceptor can be used. The contents of the respective materials and the film thickness of the charge generation layer 4 can also be the same as in the single layer-type photosensitive layer 3 of the single layer-type photoreceptor.

In the present invention, for the purposes of improving the leveling of the resulting film and imparting lubricity, a leveling agent such as silicone oil or fluorocarbon oil can also be incorporated into the laminate-type and single layer-type photosensitive layers. In addition, for the purposes of adjusting the film hardness, reducing the frictional coefficient, imparting lubricity and the like, for example, fine particles of a metal oxide (e.g., silicon oxide (silica), titanium oxide, zinc oxide, calcium oxide, aluminum oxide (alumina) or zirconium oxide), a metal sulfate (e.g., barium sulfate or calcium sulfate) or a metal nitride (e.g., silicon nitride or aluminum nitride), particles of a fluorocarbon resin such as tetrafluoroethylene resin or particles of a fluorine-containing comb-type graft polymer resin may be incorporated as well. Further, as required, other known additive(s) may also be incorporated within a range that does not markedly impair the electrophotographic properties.

In the above-described photosensitive layers, deterioration inhibitors such as an antioxidant and a light stabilizer can also be incorporated for the purpose of improving the environmental resistance and the stability against damaging light. Examples of compounds used for such purpose include chromanol derivatives such as tocopherol, as well as esterified compounds, polyarylalkane compounds, hydroquinone derivatives, etherified compounds, dietherified compounds, benzophenone derivatives, benzotriazole derivatives, thioether compounds, phenylenediamine derivatives, phosphonates, phosphites, phenolic compounds, hindered phenol compounds, linear amine compounds, cyclic amine compounds, and hindered amine compounds.

Method of Producing Photoreceptor

In the production method of the present invention, when forming the outermost layer of a photoreceptor, the slope k of a straight line obtained by plotting the average film densities of outermost layers along the ordinate and the boiling points of solvents used for the formation of the outermost layers along the abscissa is controlled to be 1.50E-4 (g/cm$^3$·° C.) or greater, preferably 2.50E-4 (g/cm$^3$·° C.) or greater, and the difference in film density of the resulting outermost layer between the surface side and the side close to the conductive substrate is adjusted to be 0.030 g/cm$^3$ or less, preferably 0.025 g/cm$^3$ or less. As a result, a photoreceptor causing no image defect even in long-term use and having excellent wear performance can be produced.

Figure 3:
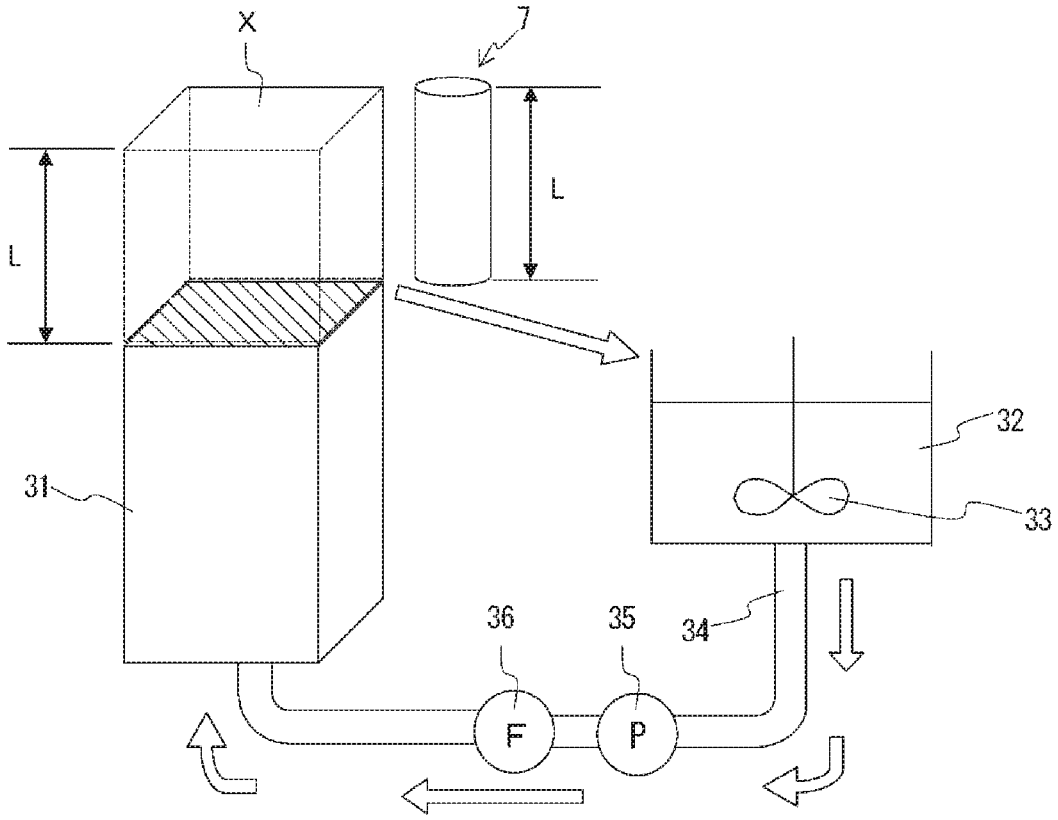
FIG. 3 is a schematic view showing one example of the production apparatus used for the method of producing a photoreceptor according to the present invention.

Further, in the present invention, when forming the outermost layer of a photoreceptor by immersion in a coating bath, the difference in film density of the resulting outermost layer along the axial direction can be reduced by controlling the vapor concentration of the coating solvent in a vapor layer region formed above the coating bath to be within a prescribed range. FIG. 3 is a schematic view showing a production apparatus used for the method of producing a photoreceptor according to the present invention. The production apparatus shown in FIG. 3 comprises: a coating bath 31, which is used for the formation of the outermost layer of a photoreceptor; a storage tank 32, which retains a coating liquid flowing from the coating bath 31; a stirring blade 33, which stirs the coating liquid in the storage tank 32; a pump 35, which is used for returning the coating liquid retained in the storage tank 32 back to the coating bath 31 through a liquid transfer pipe 34; and a filter 36. As shown in FIG. 3 by arrows, the coating liquid is circulated between the coating bath 31 and the storage tank 32 and used for the formation of the outermost layer.

As shown in FIG. 3, the vapor layer region formed above the coating bath 31 is defined as "region X", which is surrounded by the liquid surface of the coating bath 31 (shaded in FIG. 3) and the length of the outermost layer to be formed, that is, the length L of the resulting photoreceptor 7. In the present invention, it is preferred to control the amount of the solvent vapor contained in the atmosphere inside this vapor layer region X [g/m$^3$] to be 0.1% to 90%, particularly 1% to 50%, with respect to the saturated vapor amount of the solvent [g/m$^3$]. By controlling the amount of the solvent vapor to be 0.1% to 90%, the film density difference of the resulting outermost layer along the axial direction can be reduced. When the amount of the solvent vapor is greater than 90%, the productivity in the coating film formation is deteriorated, whereas when the amount of the solvent vapor is less than 0.1%, it is difficult to control the thickness of the resulting film, which potentially increases the deviation of the film density difference and makes it difficult to maintain uniform image quality.

Figure 4:
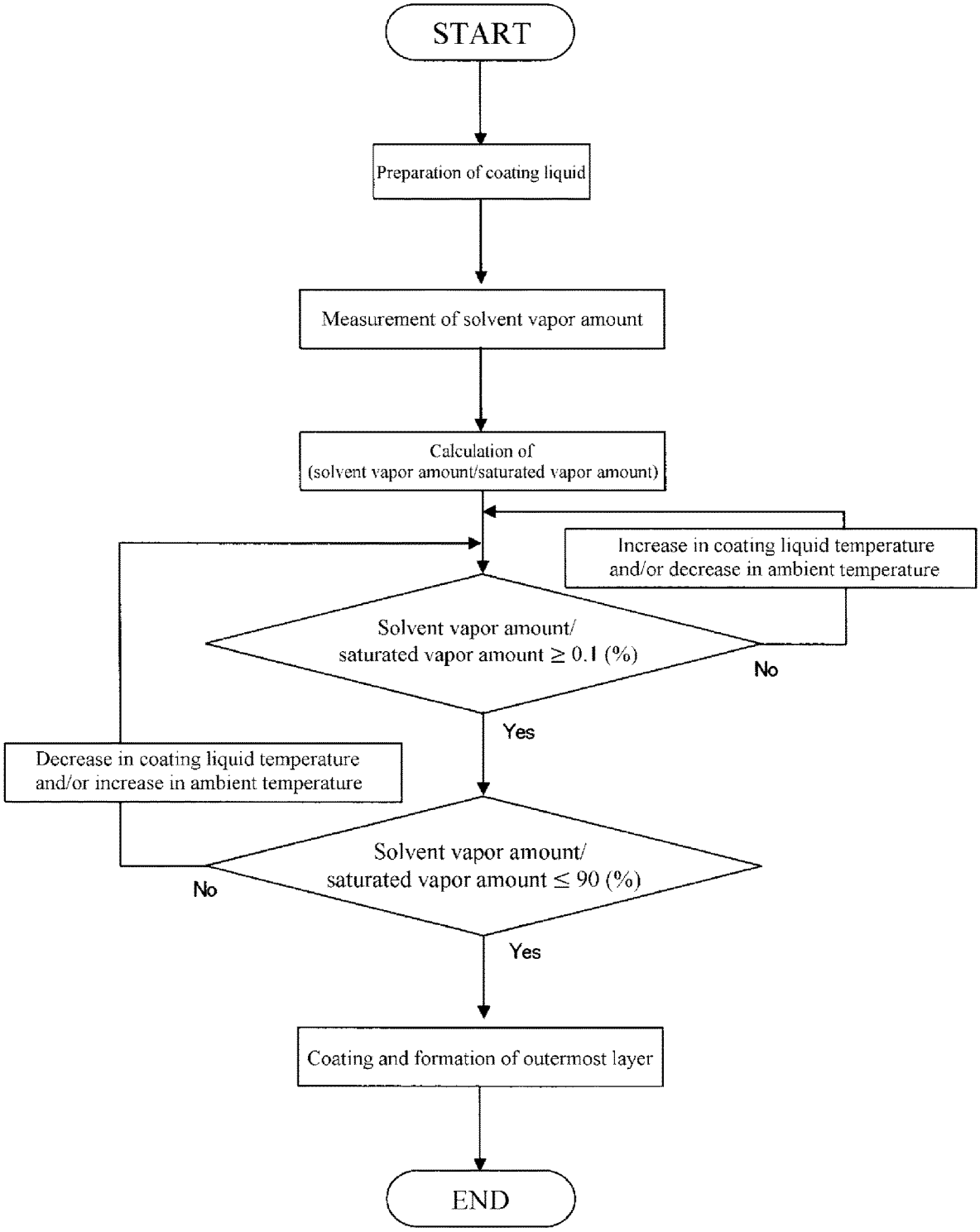
FIG. 4 is a flow chart showing the process of coat-forming the outermost layer while adjusting the amount of the solvent vapor of a coating liquid.

The amount of the solvent vapor can be controlled by modifying the conditions such as the coating liquid temperature and the ambient temperature. Specifically, as shown in the flow chart of FIG. 4, first, a coating liquid for the outermost layer formation is prepared and the solvent vapor amount thereof [g/m$^3$] is measured. Then, the ratio between the thus measured solvent vapor amount and the saturated vapor amount [g/m$^3$] of the solvent used (solvent vapor amount/saturated vapor amount; vapor density (%)) is calculated. If the thus calculated value of (solvent vapor amount/saturated vapor amount) is less than 0.1%, the value of (solvent vapor amount/saturated vapor amount) is increased by increasing the temperature of the coating liquid, lowering the ambient temperature or leaving the lid of the coating bath open for a long period prior to the coating process, or by using a combination of these means. Meanwhile, if the value of (solvent vapor amount/saturated vapor amount) is greater than 90%, the value of (solvent vapor amount/saturated vapor amount) is reduced by lowering the temperature of the coating liquid, increasing the ambient temperature or adjusting the vapor release from the vapor layer, or by using a combination of these means. When the value of (solvent vapor amount/saturated vapor amount) satisfies the condition of 0.1% to 90%, this coating liquid is used to perform coating and formation of the outermost layer.

Further, in the present invention, by increasing the boiling point of the solvent to be used, the film density of the resulting outermost layer can be increased, and the wear amount of the outermost layer when the photoreceptor is mounted on a device can thus be reduced. Therefore, by taking advantage of this property to appropriately select the solvent used for the outermost layer of the photoreceptor, the wear resistance of the resulting outermost layer can be adjusted as desired.

In photoreceptors comprising a charge transport layer as the outermost layer, this relationship is satisfied when the total amount of a charge transport material(s) and a resin binder(s) that are contained in the charge transport layer is 90% by mass or greater and the boiling points of the materials contained in the photosensitive layer are higher than the boiling point of the solvent used.

Electrophotographic Device

The electrophotographic photoreceptor of the present invention is equipped with the above-described photoreceptor of the present invention and exerts desired effects when applied to various machine processes. Specifically, sufficient effects can be obtained not only in charging processes such as contact charging systems using a charging member (e.g., a roller or a brush) and non-contact charging systems using a corotron or a scorotron, but also in development processes such as non-contact development and contact development systems using, for example, a non-magnetic single-component, magnetic single-component or two-component developing method (developing agent).

Figure 2:
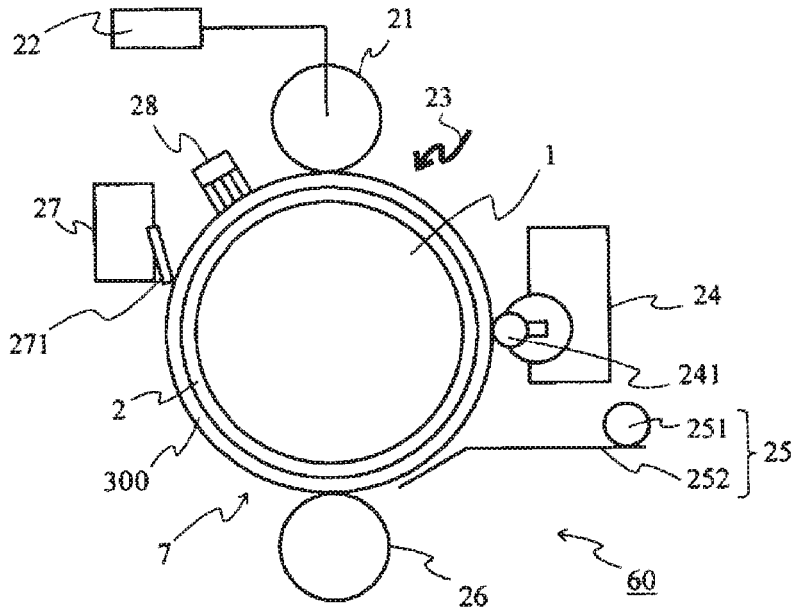
FIG. 2 is a schematic structural view showing one example of the configuration of the electrophotographic device according to the present invention.

FIG. 2 is a schematic structural view showing one example of the configuration of the electrophotographic device according to the present invention. As shown in FIG. 2, an electrophotographic device 60 of the present invention is equipped with a photoreceptor 7 of the present invention, which comprises: a conductive substrate 1; and an undercoat layer 2 and a photosensitive layer 300 covering the outer periphery of the conductive substrate 1. This electrophotographic device 60 comprises: a charging member 21 arranged on the outer periphery of the photoreceptor 7; a high-voltage power source 22 supplying voltage applied to the charging member 21; an image exposure member 23; a developer 24 equipped with a development roller 241; a paper-feeding member 25 equipped with a paper-feeding roller 251 and a paper feed guide 252; and a transfer charger (direct charging-type) 26. The charging member 21 is, for example, a member such as a roller or a brush. The electrophotographic device 60 may further comprise a cleaning device 27 equipped with a cleaning blade 271, and a charge-removing member 28. The electrophotographic device 60 of the present invention can be a color printer as well.

EXAMPLES

Concrete embodiments of the present invention will now be described in more detail by way of examples thereof. The present invention, however, is not restricted to the following Examples as long as they do not deviate from the gist of the present invention.

Production of Negatively-Chargeable Laminate-Type Photoreceptors

Example 1

A coating liquid for undercoat layer was prepared by dissolving and dispersing 5 parts by mass of an alcohol-soluble nylon (trade name "CM8000", manufactured by Toray Industries, Inc.) and 5 parts by mass of aminosilanetreated titanium oxide fine particles in 90 parts by mass of methanol. The outer periphery of an aluminum cylinder having an outer diameter of 30 mm as a conductive substrate was immersion-coated with the thus obtained coating liquid for undercoat layer and subsequently dried at a temperature of 100° C. for 30 minutes, whereby a 3 μm-thick undercoat layer was formed.

Next, 1 part by mass of Y-type titanyl phthalocyanine as a charge generating material and 1.5 parts by mass of a polyvinyl butyral resin (trade name "S-LEC BM-S", manufactured by Sekisui Chemical Co., Ltd.) as a resin binder were dissolved and dispersed in 60 parts by mass of dichloromethane to prepare a coating liquid for charge generation layer. This coating liquid for charge generation layer was immersion-coated on the above-described undercoat layer. The resultant was dried at a temperature of 80° C. for 30 minutes, whereby a 0.3 μm-thick charge generation layer was formed.

Then, 90 parts by mass of a compound represented by the following formula as a charge transport material:

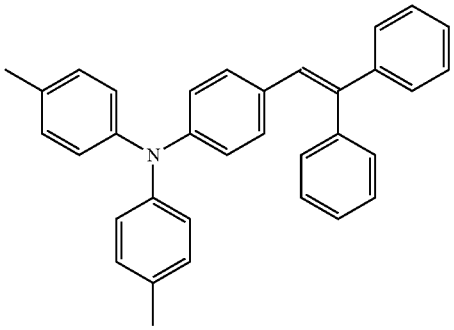

and 110 parts by mass of a resin represented by the following formula as a resin binder:

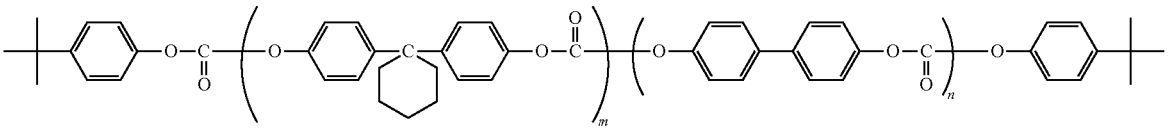

m:n = 60:40 were dissolved in 1,000 parts by mass of each solvent shown in Table 1 below to prepare coating liquids 1 to 5 for charge transport layer. These coating liquids 1 to 5 for charge transport layer (liquid temperature=22° C.) were each immersion-coated on the above-described charge generation layer at an ambient temperature of 22° C., and the resultants were dried at a temperature of 120° C. for 60 minutes to form a 24 μm-thick charge transport layer 5, whereby a negatively-chargeable laminate-type photoreceptors were prepared.

The method of measuring the vapor concentration at the time of the coating will now be described referring to FIG. 3. First, the subject photoreceptor was immersion-coated with each of the coating liquids 1 to 5 for charge transport layer, and the time between the point when the upper end of the photosensitive layer of the photoreceptor was immersed into the coating bath and the point when the lower end of the photosensitive layer of the photoreceptor existed the coating bath was measured as the coating time. Then, in order to measure the concentration of the vapor layer (vapor amount) above the coating bath, a partition covering the vapor layer region X was placed on the coating bath and, after leaving the partition for the same length of time as the thus measured coating time, the vapor in the vapor layer region X was collected and the amount thereof was measured as the solvent vapor amount at the time of the coating.

Further, the saturated vapor amount was determined by adding each solvent used in the coating liquids 1 to 5 for charge transport layer to a closed container in a half amount thereof, leaving the container to stand for 1 hour at the same temperature as that of the respective coating liquids 1 to 5 for charge transport layer, collecting the vapor from the space in the container, and then measuring the amount of the solvent component. The values of the vapor density (%), which were calculated from the thus obtained values of the solvent vapor amount in the vapor layer region X and the saturated vapor amount, are also shown in Table 1 below.

TABLE 1

| Coating liquid No. | Solvent | Boiling point (° C.) | Film density (g/cm$^3$) | Vapor density (%) |
|---|---|---|---|---|
| 1 | dichloromethane | 40 | 1.188 | 15 |
| 2 | tetrahydrofuran | 66 | 1.195 | 5 |
| 3 | 1,3-dioxolane | 74 | 1.197 | 4 |
| 4 | dichloroethane | 84 | 1.201 | 4 |
| 5 | tetrahydropyran | 88 | 1.203 | 3 |

In those cases where the vapor density was reduced to 0.1% by allowing the vapor above the coating bath to be released and where the vapor density was controlled at 90% by adding a partition above the coating bath and forcibly introducing the solvent vapor thereto, the film density was found to be roughly the same as the respective film density conditions shown in Table 1 above. However, when the vapor density was less than 0.1%, the difficulty of controlling the film thickness and a large deviation of the density difference made it difficult to keep uniform image quality and to maintain the boiling point-film density slope. Meanwhile, a vapor density of higher than 90% is not practical because the productivity is deteriorated due to slow drying of the resulting photoreceptor, difficulty of controlling the film thickness and generation of a large liquid pool.

In addition, for the charge transport layers formed in the above, three points were selected along the axial direction, about 0.02 g of each coating film was collected at these three points, the film density was measured using a dry densimeter AccuPyc 1330 (manufactured by Shimadzu Corporation, purge gas: He), and the average of the thus measured values was calculated.

Figure 5:
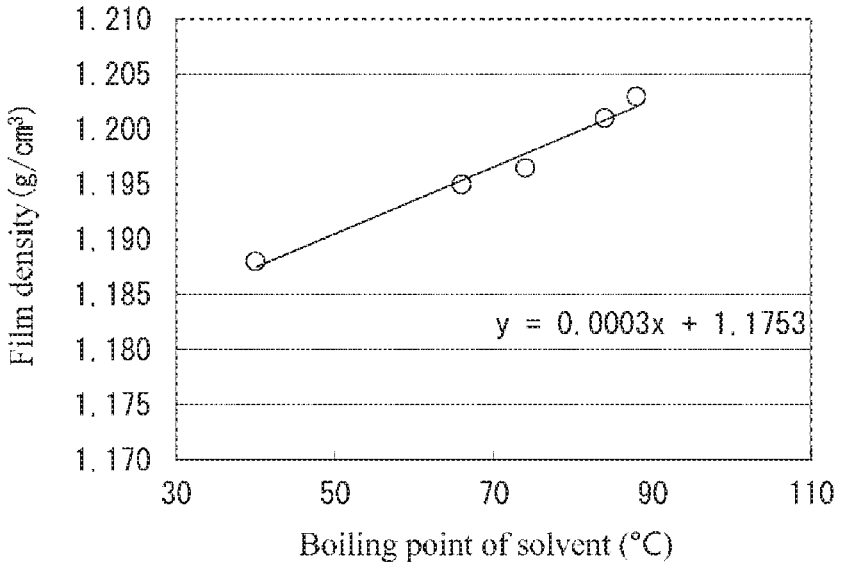
FIG. 5 is a graph showing the relationship between the average film densities of charge transport layers and the boiling points of the solvents used for the film formation.

FIG. 5 shows the relationship between the average film densities of the charge transport layers and the boiling points of the solvents used for their formation. The slope k of the first-order approximation straight line obtained in this case was found to be $2.99\times10^{-4}$ (g/cm$^3$·° C.).

The coating film of each charge transport layer that was formed using tetrahydrofuran as the solvent was scraped off from a central part of the photoreceptor using a taper-type abrasion tester (manufactured by Toyo Seiki Seisaku-sho, Ltd.), the film density was measured for every ⅓ of the film thickness, and the difference in density between the surface side and the conductive substrate side was determined. As a result, the density difference (density of the surface side−density of the conductive substrate side) was found to be 0.025 g/cm$^3$. Similarly, when dichloromethane was used, the density difference was found to be 0.027 g/cm$^3$.

Further, for the upper and lower sides during the coating of each charge transport layer, the film density of a 10% region of the photoreceptor full length was measured for every ⅓ of the film thickness, and the difference between the thus obtained maximum and minimum values was calculated. As a result, the difference was found to be 0.015 g/cm$^3$ when tetrahydrofuran was used and 0.020 g/cm$^3$ when dichloromethane was used.

Example 2

Photoreceptors were prepared in the same manner as in Example 1, except that the resin used for the charge transport layer was changed to a resin represented by the following formula:

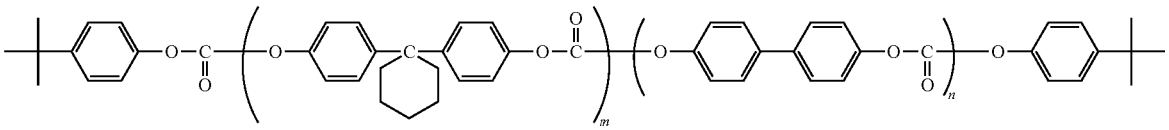

m:n = 85:15

In this case, the slope k was found to be $3.49\times10^{-4}$, and the film density difference in the thickness direction and that in the axial direction were 0.022 g/cm$^3$ and 0.015 g/cm$^3$, respectively.

Example 3

Photoreceptors were prepared in the same manner as in Example 1, except that the resin used for the charge transport layer was changed to a resin represented by the following formula:

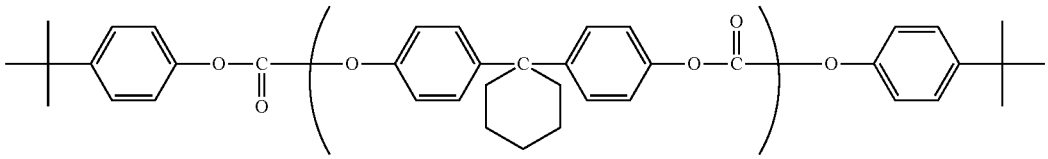

In this case, the slope k was found to be $3.04\times10^{-4}$, and the film density difference in the thickness direction and that in the axial direction were 0.025 g/cm$^3$ and 0.018 g/cm$^3$, respectively.

Example 4

Photoreceptors were prepared in the same manner as in Example 1, except that the resin used for the charge transport layer was changed to a resin represented by the following formula:

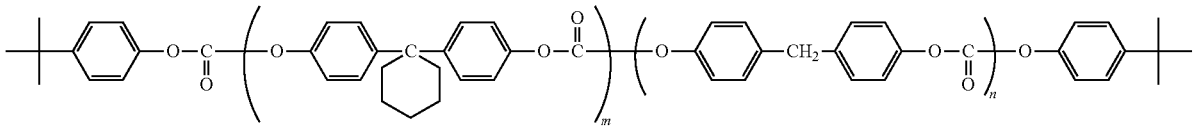

m:n = 50:50

In this case, the slope k was found to be $2.05\times10^{-4}$, and the film density difference in the thickness direction and that in the axial direction were 0.025 g/cm$^3$ and 0.015 g/cm$^3$, respectively.

Example 5

Photoreceptors were prepared in the same manner as in Example 1, except that the charge transport material was changed to a compound represented by the following formula:

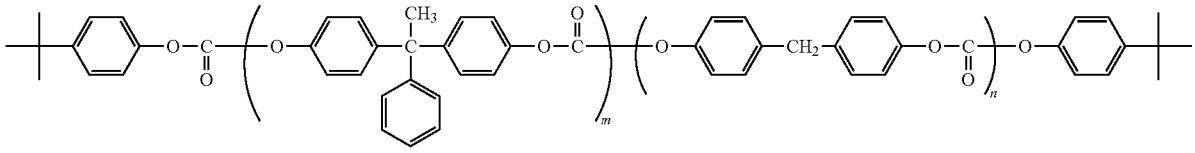

m:n = 70:30

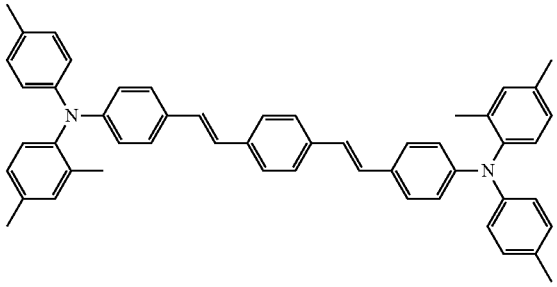

In this case, the slope k was found to be $2.85\times10^{-4}$, and the film density difference in the thickness direction and that in the axial direction were 0.024 g/cm$^3$ and 0.016 g/cm$^3$, respectively.

Example 6

Photoreceptors were prepared in the same manner as in Example 1, except that the charge transport material was changed to a compound represented by the following formula:

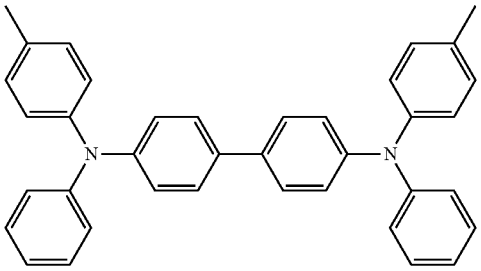

In this case, the slope k was found to be $3.05\times10^{-4}$, and the film density difference in the thickness direction and that in the axial direction were 0.020 g/cm$^3$ and 0.015 g/cm$^3$, respectively.

Comparative Example 1

Photoreceptors were prepared in the same manner as in Example 1, except that the resin used for the charge transport layer was changed to a resin represented by the following formula:

In this case, the slope k was found to be $1.33\times10^{-4}$. When tetrahydrofuran was used, the film density difference in the thickness direction and that in the axial direction were 0.040 g/cm$^3$ and 0.035 g/cm$^3$, respectively, while when dichloromethane was used, the film density difference in the thickness direction and that in the axial direction were 0.045 g/cm$^3$ and 0.042 g/cm$^3$, respectively.

Comparative Example 2

Photoreceptors were prepared in the same manner as in Example 1, except that the resin used for the charge transport layer was changed to a polyarylate resin U-100 manufactured by UNITIKA, Ltd. In this case, the slope k was found to be $0.41\times10^{-4}$, and the film density difference in the thickness direction and that in the axial direction were 0.035 g/cm$^3$ and 0.034 g/cm$^3$, respectively.

Comparative Example 3

A lid shielding those parts other than the part through which a photoreceptor would be passed at the time of coating was placed on the coating bath used in Example 1. Photoreceptors were prepared in the same manner as in Example 1, except that the photosensitive layer was coated using this coating bath. In this case, the slope k was found to be $2.99\times10^{-4}$, and the film density difference in the thickness direction and that in the axial direction were 0.045 g/cm$^3$ and 0.059 g/cm$^3$, respectively.

Evaluation of Residual Solvent

The dried charge transport layer films were each heated at 150° C. using a thermal desorption device (Curie point pyrolyzer (JHS-100A), manufactured by Japan Analytical Industry Co., Ltd.), and the gas vaporized from an area of 10 cm$^2$ of the film was collected by cold trapping to recover the solvent. The thus recovered solvent was quantitatively analyzed using a gas chromatography-mass spectrometer (GC-MS QP5000, manufactured by Shimadzu Corporation) to determine the amount of the solvent contained in the photosensitive layer (μg/cm$^2$). The amount of the residual solvent was 0.1 μg/cm$^2$ or less in all of the charge transport layers of Examples 1 to 6, and it is thus seen that the effect of the residual solvent on the film density was small.

Evaluation of Coating Bath Vapor Amount

The subject solvent used for the charge transport layer was added to a 100-ml Erlenmeyer flask in an amount of 50 ml, and the flask was capped and then left to stand at 20° C. for 24 hours. Thereafter, a certain amount of the atmosphere of the space in the flask was collected and then quantitatively analyzed using a gas chromatography-mass spectrometer (GC-MS QP5000, manufactured by Shimadzu Corporation) to determine the amount of the solvent contained in the photosensitive layer in the vapor layer. By measuring the vapor amount per unit volume, the saturated vapor amount ($\mu g/cm^3$) was determined.

Further, the coating bath vapor concentration was determined by measuring the time of pulling the subject photoreceptor out of the coating bath, subsequently placing a closed partition having the same length as the photoreceptor on top of the coating bath, leaving the partition to stand for the same length of time as the coating time, collecting the vapor from the center of the partitioned space, and then measuring the vapor amount in the same manner as above. The results of dividing the thus detected amount by the saturated vapor amount to calculate the vapor ratio at the time of the coating in percentage are shown in Table 2 below. The vapor amount at the time of the coating was in a range of 1% to 90% for all of the photosensitive layers of Examples 1 to 6; however, in Comparative Example 3, since volatilization from the solvent surface was blocked, the vapor ratio was controlled to be outside of this range and, consequently, the image quality tended to be reduced.

Evaluation of Photoreceptors

The electrical characteristics of the photoreceptors prepared in Examples 1 to 6 and Comparative Examples 1 to 3 as described above were evaluated by the following method.

Electrical Characteristics

The electrical characteristics of the photoreceptors obtained in Examples and Comparative Examples were evaluated as follows using a process simulator (CYNTHIA 91, manufactured by GEN-TECH, Inc.). For each of the photoreceptors of Examples 1 to 6 and Comparative Examples 1 to 3, the surface was charged to −650 V in dark by corona discharge under an environment having a temperature of 22° C. and a humidity of 50%, and the surface potential (V0) was measured immediately thereafter. Subsequently, after leaving the photoreceptor for 5 seconds in dark, the surface potential (V5) was measured, and the potential retention ratio (Vk5:%) at 5 seconds after the charging was determined in accordance with the following equation (1):

$$Vk5=V5/V0\times 100 \quad (1)$$

Next, starting when the surface potential reached −600 V, the photoreceptor was irradiated for 5 seconds using a halogen lamp as a light source with a 1.0-$\mu W/cm^2$ exposure light which was resolved to 780 nm through a filter, and the exposure dose required for optical attenuation to a surface potential of −300 V and the residual potential of the photoreceptor surface at 5 seconds after the exposure were evaluated as E½ ($p/cm^2$) and Vr5 (V), respectively.

Characteristics in Actual Use

The photoreceptors prepared in Examples 1 to 6 and Comparative Examples 1 to 3 were each mounted on a printer LJ4250 manufactured by HP Inc. which had been modified to be capable of measuring the photoreceptor surface potential, and 10,000 A4-size papers were printed under three temperature and humidity conditions of 5° C. and 10% RH, 20° C. and 50% RH, and 35° C. and 90% RH. The photoreceptor thickness was measured before and after the printing, and the average wear amount (μm) was evaluated after the printing in these three conditions. Further, after the printing of the 10,000 papers in each condition, a blank paper was printed and the number of black spots of 0.1 mm or larger in size in the printed area equivalent to one circumference of the photoreceptor (number of black spots/printed area equivalent to one circumference of the photoreceptor) was measured.

The results of these evaluations are also shown in Tables below.

TABLE 2

| | Solvent used for charge transport layer | Slope k (×10E−4) | Density difference ($g/cm^3$) Thickness direction | Density difference ($g/cm^3$) Axial direction | Vapor layer above coating bath (%) | Amount of residual solvent in photosensitive layer ($\mu g/cm^2$) |
|---|---|---|---|---|---|---|
| Example 1 | tetrahydrofuran | 2.99 | 0.025 | 0.015 | 5.2 | <0.1 |
| | dichloromethane | | 0.027 | 0.020 | 15.0 | <0.1 |
| Example 2 | tetrahydrofuran | 3.49 | 0.022 | 0.015 | 5.3 | <0.1 |
| Example 3 | tetrahydrofuran | 3.04 | 0.025 | 0.018 | 6.0 | <0.1 |
| Example 4 | tetrahydrofuran | 2.05 | 0.025 | 0.015 | 5.1 | <0.1 |
| Example 5 | tetrahydrofuran | 2.85 | 0.024 | 0.016 | 5.4 | <0.1 |
| Example 6 | tetrahydrofuran | 3.05 | 0.020 | 0.015 | 5.3 | <0.1 |
| Comparative | tetrahydrofuran | 1.33 | 0.040 | 0.035 | 5.0 | <0.1 |
| Example 1 | dichloromethane | | 0.045 | 0.042 | 14.5 | <0.1 |
| Comparative Example 2 | tetrahydrofuran | 0.41 | 0.035 | 0.034 | 5.6 | <0.1 |
| Comparative Example 3 | tetrahydrofuran | 2.99 | 0.045 | 0.059 | 0.5 | <0.1 |

TABLE 3

| | Electrical characteristics | | | | Image characteristics | | |
|---|---|---|---|---|---|---|---|
| | Retention rate Vk5 (A) | Sensitivity 1/2 (μJ/cm$^2$) | Residual potential (V) | Average wear amount (μm) | 5° C., 10% RH | 20° C., 50% RH | 35° C., 90% RH |
| Example 1 | 96.2 | 0.14 | 27 | 2.19 | none | none | 1 |
| | 96.4 | 0.14 | 25 | 2.39 | none | none | 1 |
| Example 2 | 96.3 | 0.13 | 22 | 2.93 | none | none | 1 |
| Example 3 | 97.2 | 0.13 | 21 | 3.46 | 1 | 1 | 2 |
| Example 4 | 96.5 | 0.13 | 23 | 2.53 | none | none | 1 |
| Example 5 | 95.2 | 0.13 | 15 | 2.79 | none | none | 1 |
| Example 6 | 95.4 | 0.13 | 18 | 2.26 | none | none | 1 |
| Comparative | 96.0 | 0.14 | 26 | 3.45 | 4 | 5 | 8 |
| Example 1 | 96.2 | 0.14 | 24 | 3.46 | 3 | 5 | 7 |
| Comparative Example 2 | 95.2 | 0.15 | 29 | 3.59 | 3 | 5 | 10 |
| Comparative Example 3 | 96.0 | 0.14 | 29 | 2.40 | 2 | 2 | 3 |

According to the results shown in Tables above, in Examples 1 to 6, the electrical characteristics of the photoreceptors were comparable to those of Comparative Examples; however, since the values of the slope k were in the range of the present invention, black spots in the respective environments after a large number of printing operations were either absent or observed in a very small number. In contrast, in Comparative Examples 1 to 3, a large number of image defects in the form of black spots were found on the printed images, and they were observed particularly under the high-temperature and high-humidity conditions. Therefore, in Examples 1 to 6, it is believed that the film constitutions having a large density change depending on the boiling point of the solvent contributed to the improved image stability under the high-temperature and high-humidity environments, although the mechanism thereof is not clear. Moreover, in Example 1, it is seen that the film wear performance was adjusted based on the difference in solvent species without a large change in other characteristics.

From the above, it was confirmed that an electrophotographic photoreceptor which yields good images having no image defect can be realized by applying the present invention.

What is claimed is:

1. A method of producing an electrophotographic photoreceptor comprising a conductive substrate and a photosensitive layer provided on the conductive substrate, said method comprising, in the formation of an outermost layer:

controlling slope k of a straight line obtained by plotting average film density of the outermost layer and boiling point of a solvent used for the formation of said outermost layer along the ordinate and the abscissa, respectively, to be 1.50E-4 (g/cm$^3$·° C.) or greater; and adjusting the difference in film density of said outermost layer between the surface side and the side close to said conductive substrate to be 0.030 g/cm$^3$ or less.

* * * * *